US005335846A

United States Patent [19]

Smith et al.

[11] Patent Number: 5,335,846

[45] Date of Patent: Aug. 9, 1994

[54] CRUSHABLE SHIPPER

[75] Inventors: Sidney T. Smith, Lake Forest; James Chase, Grayslake; Jeffrey R. Sonderman, Island Lake, all of Ill.

[73] Assignee: Clintec Nutrition Company, Deerfield, Ill.

[21] Appl. No.: 993,396

[22] Filed: Dec. 21, 1992

[51] Int. Cl.[5] ..... B65D 5/50; B65D 5/48

[52] U.S. Cl. ..... 229/120.32; 206/594; 220/410

[58] Field of Search ..... 229/120.32, 120.37; 220/408, 410, 441, 445; 206/585, 593, 594

[56] References Cited

U.S. PATENT DOCUMENTS

| | | | |
|---|---|---|---|
| 1,344,147 | 6/1920 | Potter | 206/594 |
| 1,655,071 | 1/1928 | Oppenheim | 206/594 |
| 1,682,411 | 8/1928 | Oppenheim | 206/594 |
| 1,808,136 | 6/1931 | Gray | 206/594 |
| 1,840,677 | 1/1932 | Miessler | 206/594 |
| 2,160,816 | 6/1939 | Barnes | 206/594 |
| 2,513,902 | 7/1950 | Tyrseck | 206/594 |
| 2,669,351 | 2/1954 | Carson et al. | 206/594 |
| 2,740,574 | 4/1956 | Laver | 206/594 |
| 2,807,402 | 9/1957 | Nelbach | 220/410 |
| 2,835,428 | 5/1958 | Herzog | 206/594 |
| 3,079,061 | 2/1963 | Wojcik | 220/445 |
| 3,161,339 | 12/1964 | Weller | 220/445 |
| 3,279,677 | 10/1966 | Wojcik | 206/594 |
| 4,180,164 | 12/1979 | Durden et al. | 206/593 |

*Primary Examiner*—Gary E. Elkins
*Attorney, Agent, or Firm*—Hill, Steadman & Simpson

[57] ABSTRACT

A shipping container for transporting at least one product within compartments of the container. The container has a shell defining an interior body and at least one compartment therein. The compartment has a plurality of zones defined by walls abutting at least one outer surface of each compartment. In an embodiment, compartments further include legs projecting from at least one of its surfaces to project between zones or between a zone and the shell of the container. Due to the structure of the compartments within the container, products contained within the compartments are less susceptible to damage since the zones and the shell absorb external impacts prior to impacting the products within the compartments.

17 Claims, 2 Drawing Sheets

CRUSHABLE SHIPPER

BACKGROUND OF THE INVENTION

The present invention relates generally to a housing for use in shipping and handling of a product contained within the housing. More specifically, the invention relates to a housing for shipping a flexible fluid filled container within the housing and preventing or reducing the risk of damage to the fluid container.

It is, of course, known to ship products of all types in a container or other housing. Typically, a housing in the form of a box having four side walls, a top wall and a bottom wall is used for shipping a product.

Due to concerns with respect to damaging and/or breaking of products during shipment, a number of techniques for packaging products within the housing have been used to reduce the likelihood that the product being shipped is damaged. For example, it is known to use packaging material, e.g., foam-like pieces, to pack the product and limit shifting of the product within the housing. Alternatively, the product may be secured in so-called "bubble wrap" which places any direct stresses from handling during shipment on compressed air bubbles rather than the product itself.

It is known in a number of industries, e.g. the medical industry, to package liquid products in flexible containers. These containers are generally constructed from flexible sheets of plastic of various forms and structures. The containers are constructed so as to house different volumes of fluid. Some containers are designed to house small amounts of fluid, e.g. 50 ml, while other containers are constructed to house large volumes, for example a liter of fluid or more.

One problem in constructing large volume fluid filled flexible containers is the shipment of same. Due to external forces on the containers during shipping as well as hydraulic forces exerted by the fluid within the containers, large volume flexible containers are extremely vulnerable to rupture during shipment. Indeed, the inability to ship large volume fluid filled containers without breakage has limited the use and shipment of certain sized fluid filled flexible containers.

One solution proposed to overcome the problem of rupture to large volume fluid filled flexible containers is to strengthen the primary container material(s) to withstand external forces which may cause rupture of the container. For example, more expensive grades of plastic can be used for the layer(s) of the container, or in the alternative, stronger types of glues between layers can be used to provide additional strength against rupture of the container. Such measures, however, substantially increase the cost of the containers.

A need exists, therefore, for an improved container for shipping or transporting products, such as fluid filled flexible containers.

SUMMARY OF THE INVENTION

The present invention provides a shipping container for transporting, without product failure, large volume flexible containers filled with fluid.

To this end, in an embodiment, the present invention provides a shipping container for transporting at least one product. The shipping container comprises a shell having at least one compartment included within the shell for holding the product to be transported. A plurality of zones are included within the shell for defining an area between walls of the shell and at least one surface of the compartment. The walls of the zone are so arranged and constructed to create a rebound zone above and/or below the compartment. Pursuant to the present invention, a two level distribution and absorption system is provided.

In an embodiment, the compartments include a leg or plurality of legs projecting perpendicularly from one of the surfaces of each compartment. The legs of the compartments, in an embodiment, define, in part, the zones.

In an embodiment, the zones are defined by inserts and the compartments do not, preferably, include legs.

In an embodiment, the shell is constructed from a crushable material such as cardboard. The shell is designed to crush and absorb the energy of an impact so that same is spent, and will not damage the enclosed product.

Additionally, preferably, the compartment that houses the product includes a supporting surface that can flex. This allows displacement of the floor or roof of the compartment so that the product can decelerate over a reasonable distance. This can also ensure that one flexible container will not transfer additional shock to another flexible container within the shipper.

Preferably, at least two compartments are defined in the shipper.

An advantage of the present invention is that it provides an improved shipping container.

A further advantage of the present invention is that it provides a shipping container for transporting fluid filled large volume flexible containers without damage to the transported containers.

Still further, an advantage of the present invention is that it provides a two level impact distribution and absorption system.

Furthermore, an advantage of the present invention is that it provides a shipping container which is compact for transporting a plurality of products.

Moreover, an advantage of the present invention is that it provides a shipping container in which the shell and the compartments absorb external impacts lessening the shock transmitted to the products within the compartments.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an improved shipping container. The shipping container provides means for containing and shipping products without damage to the products from external impacts to the container.

Figure 1:
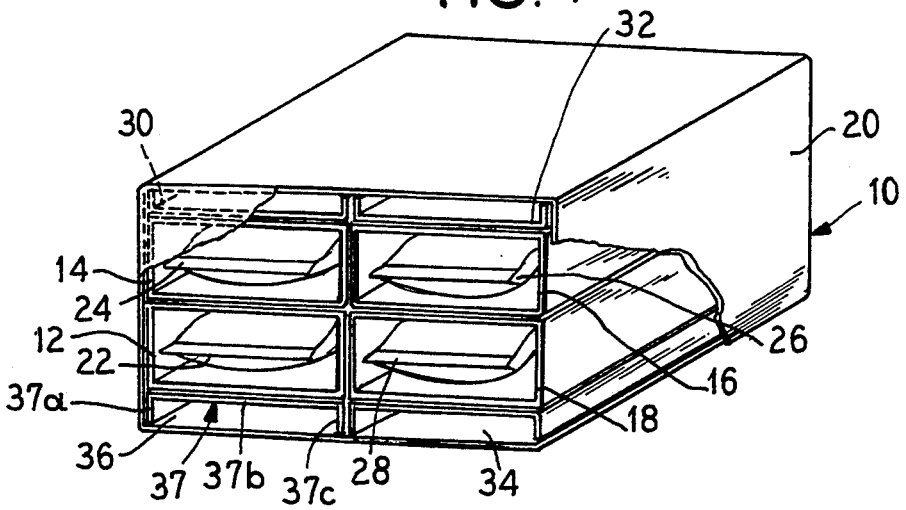
FIG. 1 illustrates a perspective view of an embodiment of the crushable fluid shipper of the present invention.

Referring now to FIG. 1, an embodiment of the shipping container 10 is generally illustrated. In the illustrated embodiment, the container 10 includes four separate compartments 12, 14, 16 and 18. Although in the illustrated embodiment, the container 10 comprises four compartments 12, 14, 16 and 18, it should be appreciated that in use the container 10 can comprise more than four compartments or less than four. In the preferred embodiment illustrated, each of the compartments 12, 14, 16 and 18 has a substantially similar construction.

Each of the compartments 12, 14, 16 and 18 defines an interior that can house at least one product 22, 24, 26 and 28, respectively, for shipment or transport. In this regard, the compartments 12, 14, 16 and 18 preferably have an elongated rectangular shape. As illustrated, in a preferred embodiment, the products 22, 24, 26 and 28 are flexible containers, such as enteral feeding bags, containing a liquid. Most preferably, the container 10 is designed to house large volume fluid filled containers, i.e. containers designed to house one liter or more of fluid.

As illustrated, the container 10 includes a shell 20 which provides a sufficiently stiff outer surface for the container 10. The shell 20 entirely encloses products contained therein. In a preferred embodiment, the shell 20 is a box constructed from corrugated-type cardboard. One end of the shell 20 can be glued, taped, or otherwise sealed together and providing a means for opening the container 10. After shipment, the end of the shell 20 is opened and product housed therein can be accessed.

Vertically displaced above a bottom wall of the shell 20 and below a top wall of the shell 20 are open areas 30, 32, 34 and 36. Each of the open areas 30, 32, 34 and 36 has a substantially similar construction. Accordingly, for the sake of brevity, only open area 36 will be discussed below. As discussed hereinafter, the open areas 30, 32, 34, and 36 provide, in part, for controllable movement of the product housed within compartments 12, 14, 16, and 18 during impact. Additionally, the open areas 30, 32, 34, and 36 provide crushable zones that prevent products housed within the container from being damaged during impact.

The open area 36 in the embodiment illustrated in FIG. 1 is preferably defined by an integrally formed insert 37 having three walls 37*a*, 37*b* and 37*c*. The walls 37*a* and 37*c* are substantially perpendicular to the wall 37*b* which, when positioned, is substantially parallel to the bottom wall of the shell 20. As a result, a narrow, rectangular open area 36 is formed by the insert 37 with a bottom wall formed by a portion of the bottom wall of the shell 20. The open areas 30, 32, and 34 are similarly constructed.

Figure 2:
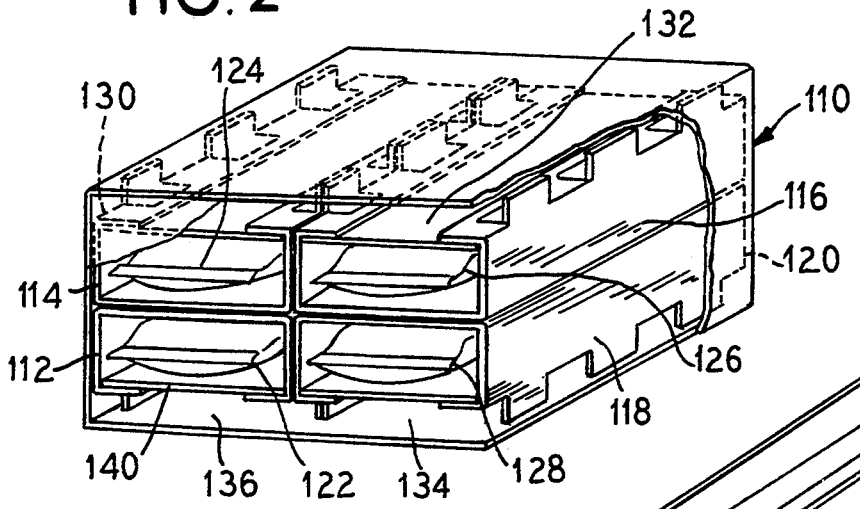
FIG. 2 illustrates a perspective view of another embodiment of the crushable fluid shipper of the present invention.

Of course, it will be appreciated that there are a variety of ways to create open areas 30, 32, 34, and 36. FIG. 2 illustrates a shipper 110 wherein the open areas 130, 132, 134, and 136 are created by using legs extending from compartments 112, 114, 116, and 118. In such a case, inserts are not required as the legs define the necessary open areas.

Figure 3:
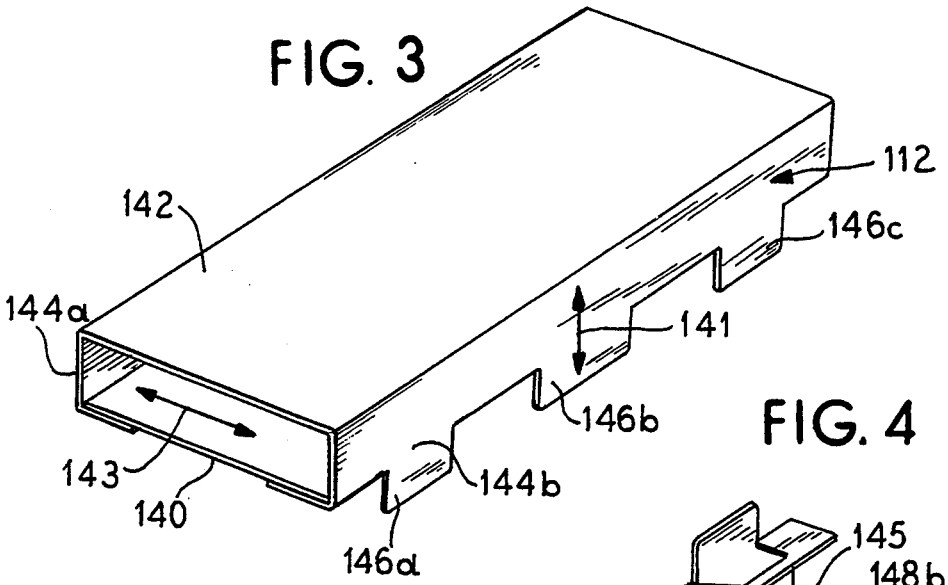
FIG. 3 illustrates a perspective view of an embodiment of a single compartment of the shipper of FIG. 2.
Figure 4:
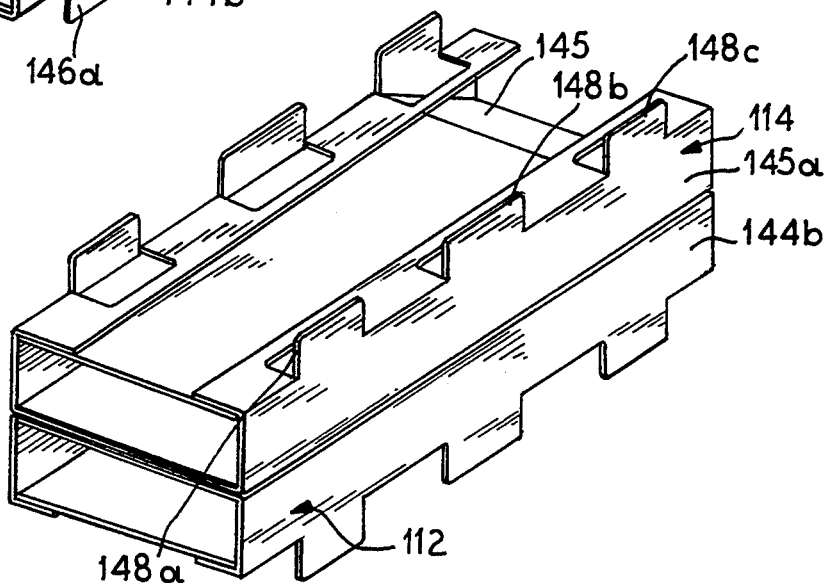
FIG. 4 illustrates a perspective view of an embodiment of two stacked compartments of the shipper of FIG. 2.

Referring now to FIG. 3, an individual compartment 112 is illustrated, as used in the embodiment of the shipper 110 illustrated in FIG. 2. Two stacked compartments 112 and 114 are illustrated in FIG. 4. The compartments 112, 114, 116, and 118 can be constructed from a variety of materials. Likewise, the compartments of 12, 14, 16 and 18 of the shipper 10 of FIG. 1 can be constructed from a variety of materials. In a preferred embodiment, the compartments are constructed from a cardboard-like material. For example, the compartments can be constructed from a corrugated-type cardboard, however, other rigid materials can be used. If cardboard is used, the corrugation flutes of the side wall of the open zone should be perpendicular to the rebound surface.

Referring now specifically to FIG. 3, compartment 112 is illustrated. Only compartment 112 will be referred to, since each of the compartments 112, 114, 116 and 118 preferably has substantially the same shape and construction. The compartment 112 can be integrally formed or separately formed with two or more pieces of material. The compartment 112 includes a bottom wall 140, a top wall 142 and sidewalls 144*a* and 144*b*. Each of the sidewalls 144*a* and 144*b* includes one or more legs 146*a*, 146*b* and 1456*c*. The bottom wall 140, as discussed in more detail below, is designed to bend or flex in response to an impact so that at least portions thereof move into the open area 136 during impacts of the container.

In the preferred embodiment illustrated in FIG. 3, the sidewall 144*b* includes three legs 146*a*, 146*b* and 1456*c*. Likewise, the sidewall 144*a* includes three legs 148*a*, 148*b* and 148*c* as shown for compartment 114 in FIG. 4. If desired, fewer or more legs can be utilized and the legs may be of different sizes and shapes. For example, FIGS. 6 and 7 disclose an embodiment, which will be discussed infra, where only one elongated leg is provided.

In the embodiment illustrated in FIGS. 3 and 4, the bottom surface 140 of the compartment 112 is non-integrally formed with the sidewalls 144*a* and 144*b* and the top wall 142. The sidewalls 144*a* and 144*b* are integrally formed with the top wall 142. It will be appreciated, however, that all of the walls 140, 142, 144*a* and 144*b* may be integrally formed as well. The sidewalls 144*a* and 144*b* can be secured to the underside of the bottom wall 140 as shown in FIG. 3. In this way, the legs are formed from portions of the sidewalls 144*a* and 144*b* which are secured beneath the bottom wall 140. The leg(s) 146*a*, 146*b* and 1456*c* preferably have a stiffening effect running perpendicular to the rebound surface 140.

In the preferred embodiment illustrated in FIG. 3, when the compartments 112 and 114 are stacked, their respective top walls 142 substantially lay on top of each other. As a result, the legs 146*a*, 146*b*, 1456*c*, 148*a*, 148*b* and 148*c* project vertically upward in a direction substantially perpendicular to the bottom surface 140 of the compartment 114. Furthermore, the legs 146*a*, 146*b* and 1456*c* project vertically downward from the bottom surface 140 of the compartment 112.

As a result, a planar, non-integral wall is formed from sidewalls 144*b* of compartment 112, sidewall 145*a* of compartment 114 and the respective legs integrally formed with each of the sidewalls 144*b* and 145*a*. An opposite and substantially parallel wall is formed from the opposite sidewalls and their respective legs of the compartments 112 and 114, respectively.

As illustrated in FIG. 4, the bottom wall 140 of the compartment 114 can be integrally formed with the top wall 142 by forming a slanted wall 145 between the legs and a correspondingly slanted or vertical wall can be formed similarly (not shown) to enclose the container. As a result, the product (not shown) within the compartment 114 can only be inserted and removed through a front opening to the compartment 114.

In a preferred embodiment, the compartments 112 and 114 are then placed within the shell 120 such that the legs of the compartments 112 and 114 are between the sidewalls of adjacent open areas 130 and 132 or adjacent open areas 134 and 136, or between a single sidewall of one of the open areas 130, 132, 134 or 136 and a portion of the sidewalls of the shell 120.

In a preferred embodiment, the legs of the compartments are formed of the same material as the flexing floor 140 of the compartment, but having the stiffness, such as flutes, vertically arranged 141 in the legs and side walls of the compartment and axially and in-line 143 with the side walls **144*a* and 144*b* of the compartment along the flexing surface 140. The legs and/or the side walls, 144*a* and 144*b*, of the compartment can be comprised of a stiffer material than the flexing surface 140**. As a result, the flexible bottom wall of the compartment flexes with the abutting wall of the open area.

The shipping container 110 is designed to house products within the compartments 112, 114, 116 and 118. To this end, the compartments 112, 114, 116 and 118 can be filled with flexible fluid filled containers. Of course, other products to be shipped or transported can be housed within the compartments 112, 114, 116 and 118.

In the embodiment illustrated in FIG. 2, the outer shell 120 defines the interior of the container 110 which includes the four compartments 112, 114, 116 and 118 and the four open areas 130, 132, 134 and 136. The open areas 130, 132, 134 and 136 provide for controlled movement of the product in the case of impact to the container 110. The voids between the legs of the compartment provide the shipper 110 a crush zone that absorbs shocks without transferring the shock to the compartment or container. The legs of the compartments can also crush to further absorb shocks and therefore reduce shocks that are transferred to the container.

During impact to the container 110, the floor of the compartments 112, 114, 116 and 118 flex, bend, and/or displace into the open areas 130, 132, 134 and 136. This prevents the products 122, 124, 126 and 128 housed within the compartments 112, 114, 116 and 118 from absorbing the impact prior to the walls of the compartment and the legs extending from the compartments.

Pursuant to the present invention, the strength of the shell 120 is typically weaker than the container of the product housed within the compartments 112, 114, 116 and 118. As a result, impacts are absorbed by the shell 120 before the impact damages the products 122, 124, 126 and 128 within the compartments 112, 114, 116 and 118. The energy of any impact that might damage the fluid container is spent upon the shell 120 which will fail before it can transmit a greater shock to the product that is being shipped. Due to the legs of the compartments, the products within the compartments are set off from the shell and will not be damaged as the shell crushes.

As previously stated, the legs and floors of the compartments 112, 114, 116 and 118 are constructed so as to allow the floor to yield at impact first without touching the inner wall of the shell 120. Therefore, for example, at impact at least portions of floor 140 of the compartment 112 will move into the open area 136. Consequently, the impact is absorbed by the legs which decreases the inertial shock to the housed product from the impact. The deceleration at impact is over a much greater distance thereby decreasing the internal hydrostatic shock within the flexible container being transported. Thus, the open areas form rebound zones. In this regard, the open areas provide for controlled movement of the products at the time of impact and repeatedly serve to absorb small shocks; the rebound zones provide an area for deceleration to occur.

Figure 6:
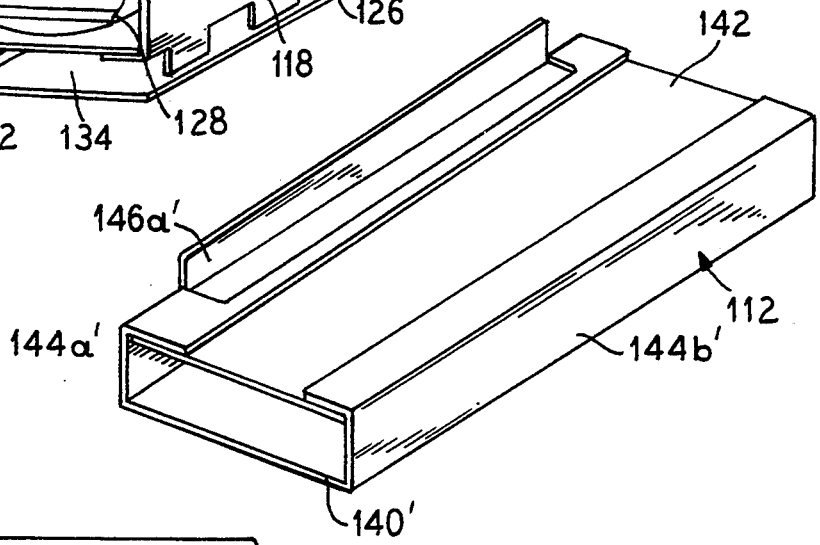
FIG. 6 illustrates a perspective view of another embodiment of a compartment of the shipper of the present invention.
Figure 7:
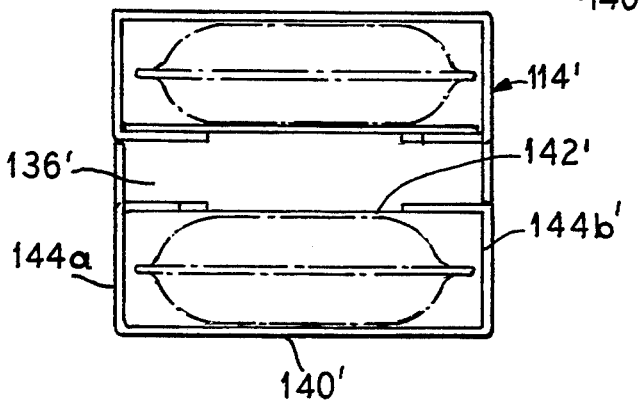
FIG. 7 illustrates a perspective view of two stack compartments of the embodiment illustrated in FIG. 6.

It shall be noted that as illustrated in FIGS. 6 and 7, a rebound zone can be placed between compartments. If a rebound zone is placed between the compartments, it prevents one container from transferring initial shock to another container.

Due to the construction of the present invention, fluid filled flexible containers which heretofore could not be shipped without substantial product failure can now be safely shipped. Pursuant to the present invention, large shocks are absorbed by the containers 10 and 110 before they can be transferred to the product. The floors of the compartments can flex and absorb the kinetic energy from the impact preventing damage to the products housed therein. The severe and/or localized impact which can be potentially transferred to the product contained within the compartments is thereby ameliorated by the shell, the compartments and the open areas.

The shell 20 and 120 provides a fully enclosed container for shipping the products. However, if desired, the containers 10 and 110 can be placed in a further box, with other containers 10 and 110, for transport of the product.

Figure 5:
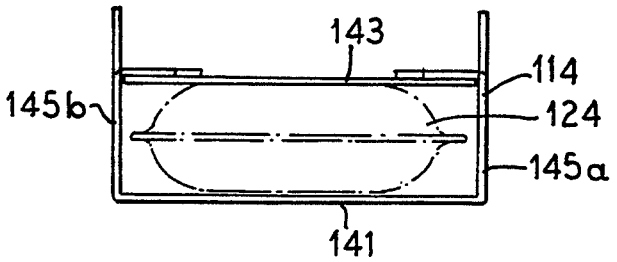
FIG. 5 illustrates an end view of a compartment of the shipper of FIG. 2.

As illustrated in FIG. 5, a flexible container 124, is enclosed within the compartment 114 about its periphery by the sidewalls **145*a* and 145*b*, the top wall 143 and the bottom wall 141. The compartment 112 as shown is inverted and is laying on its top wall 142**.

FIGS. 6 and 7 illustrate an alternate embodiment of a compartment 112' of the present invention. The compartment 112' is formed of a bottom wall 140', sidewalls **144*a*' and 144*b*', top wall 142'. The sidewall 144*a*' includes a leg 146*a*40 projecting perpendicularly from the top wall 142' and along a portion of the compartment. As illustrated, preferably only one leg 146*a*'** is provided. However, a plurality of legs can be provided on the one side instead of one contiguous leg.

As illustrated in FIG. 7, the compartment 112' may be stacked with another like compartment 114'. The compartments 112' and 114' are then stacked within a shell to form a shipping container. Due to the structure of the compartments 112' and 114', a rebound or open zone 136' is provided between the compartments as opposed to at a top or bottom thereof. However, if desired, the compartments 112' and 114' can be used with inserts such as those illustrated in FIG. 1 to provide open areas on the top and bottom of each compartment as well as between each compartment.

It should also be appreciated, that non-removable shells or dividers can be used to create the compartments and rebound areas of the present invention. Such dividers can be built into the shell.

It should be understood that various changes and modifications to the presently preferred embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

We claim:

1. A shipping container for housing at least one product comprising:

a shell having a top wall, a bottom wall and four side walls;

a compartment within the shell for housing the product, the compartment having a top surface, a bottom surface, and two side surfaces and at least one leg projecting from the compartment substantially perpendicularly from one of the surfaces as an extension of and coplanar to at least one of the two side surfaces;

a first zone within the shell, the first zone defined by at least a portion of the shell, the bottom surface and the at least one leg of the compartment, the zone further defining an open area below the compartment allowing the bottom surface to flex into the first zone in response to a force.

2. The shipping container of claim 1 wherein at least two of the surfaces of the compartment are integrally formed.

3. The shipping container of claim 1 wherein the compartment further comprises a back wall.

4. The shipping container of claim 1 wherein the shell is constructed from a crushable compartment that will crush in response to an impact before the product is damaged.

5. The shipping container of claim 1 wherein the first zone is defined by an insert.

6. The shipping container of claim 1 further comprising:

at least one additional compartment, wherein the compartments are stacked on top of each other within the shell.

7. A shipping container for transporting at least two large volume fluid filled flexible containers comprising:

a shell having a top wall, a bottom wall and four side walls;

at least two compartments within the shell for housing the flexible containers, each of the at least two compartments having a top surface, a bottom surface, two side surfaces and at least one leg extending substantially perpendicularly from the bottom surface as an extension of and coplanar to at least one of the two side surfaces; and a zone defined by at least a portion of the shell, the bottom surface and the at least one leg, the zone further defining an open area to allow the bottom surface of one of the at least two compartments to flex thereinto.

8. The shipping container of claim 7 wherein the zone is located between the at least two compartments.

9. The shipping container of claim 7 wherein the zone is located between one of the at least two compartments and the shell.

10. The shipping container of claim 7 including at least one additional zone, the zones located between each of the at least two compartments and the shell.

11. The shipping container of claim 7 wherein the zone is defined by an insert.

12. A container for housing large volume fluid filled containers comprising:

an outer shell that defines an interior;

at least two compartments located in the interior, each of the at least two compartments receiving one of the fluid filled containers, each of the at least two compartments including a top surface, a bottom surface, two side surfaces, and a plurality of legs extending from the bottom surface as an extension of and coplanar to the side surfaces, the at least two compartments being aligned in the shell one above the other; and at least two open areas within the shell defining a first zone between the top surface of one of the at least two compartments and the shell and a second zone between the bottom surface of another one of the at least two compartments and the shell, the zones defined by at least a portion of the shell, the bottom surface and the plurality of legs.

13. The container of claim 12 wherein each of the at least two compartments includes at least one of the zones between each of the at least two compartments.

14. The container of claim 12 wherein the shell is constructed from a crushable material.

15. The container of claim 12 wherein the container provides two separate means for absorbing and distributing impact energy.

16. The container of claim 12 wherein each of the at least two compartments includes a back wall that extends substantially perpendicular to the bottom surface.

17. The container of claim 13 including at least one removable insert for defining each of the at least two open areas.

* * * * *